US012667152B2

(12) United States Patent
Hoyd

(10) Patent No.: US 12,667,152 B2
(45) Date of Patent: Jun. 30, 2026

(54) WIG APPARATUS HAVING SAFEGUARDS

(71) Applicant: Shawnee Hoyd, Los Angeles, CA (US)

(72) Inventor: Shawnee Hoyd, Los Angeles, CA (US)

( * ) Notice: Subject to any disclaimer, the term of this patent is extended or adjusted under 35 U.S.C. 154(b) by 55 days.

(21) Appl. No.: 18/907,473

(22) Filed: Oct. 5, 2024

(65) Prior Publication Data

US 2026/0096616 A1 Apr. 9, 2026

(51) Int. Cl.
*A41G 3/00* (2006.01)

(52) U.S. Cl.
CPC ..... *A41G 3/005* (2013.01)

(58) Field of Classification Search
None
See application file for complete search history.

(56) References Cited

U.S. PATENT DOCUMENTS

2019/0125019 A1* 5/2019 LeBeau ..... A41G 3/0016
2021/0177079 A1* 6/2021 Kim ..... A41G 3/0016
2022/0330640 A1* 10/2022 Wilson ..... A41G 5/0053
2023/0232924 A1* 7/2023 Kim ..... A41G 3/005 132/54

* cited by examiner

*Primary Examiner* — Tatiana L Nobrega

(57) ABSTRACT

A Wig Apparatus Having Safeguards comprises an enhanced wig cap system designed to provide secure attachment between a wig and the wearer's head. The apparatus incorporates a conventional wig cap modified with dual securing mechanisms: a series of strategically placed loop fasteners on the cap's outer surface that engage with the wig's underside, and multiple reinforced pinholes positioned along both the outer and underside surfaces of the cap that anchor the entire assembly to the wearer's head. This dual-attachment system provides superior stability and discretion compared to traditional wig caps. The combination of loop fasteners and pinholes ensures the wig remains securely fastened during daily activities, enhancing user confidence and maintaining proper wig placement. The apparatus effectively addresses common concerns regarding wig security and discretion while utilizing a simple, practical design.

9 Claims, 6 Drawing Sheets

WIG APPARATUS

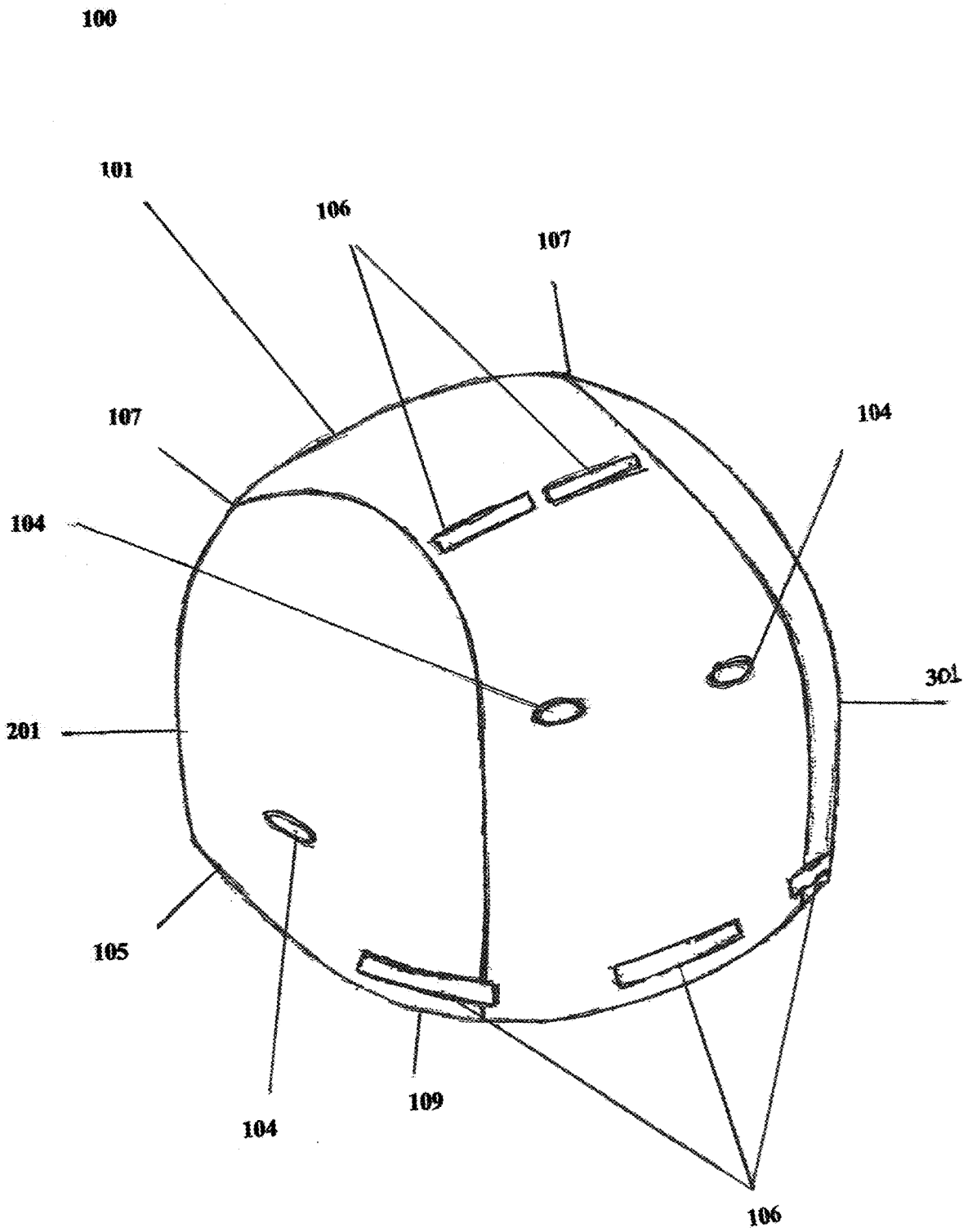
FIG. 1 WIG APPARATUS

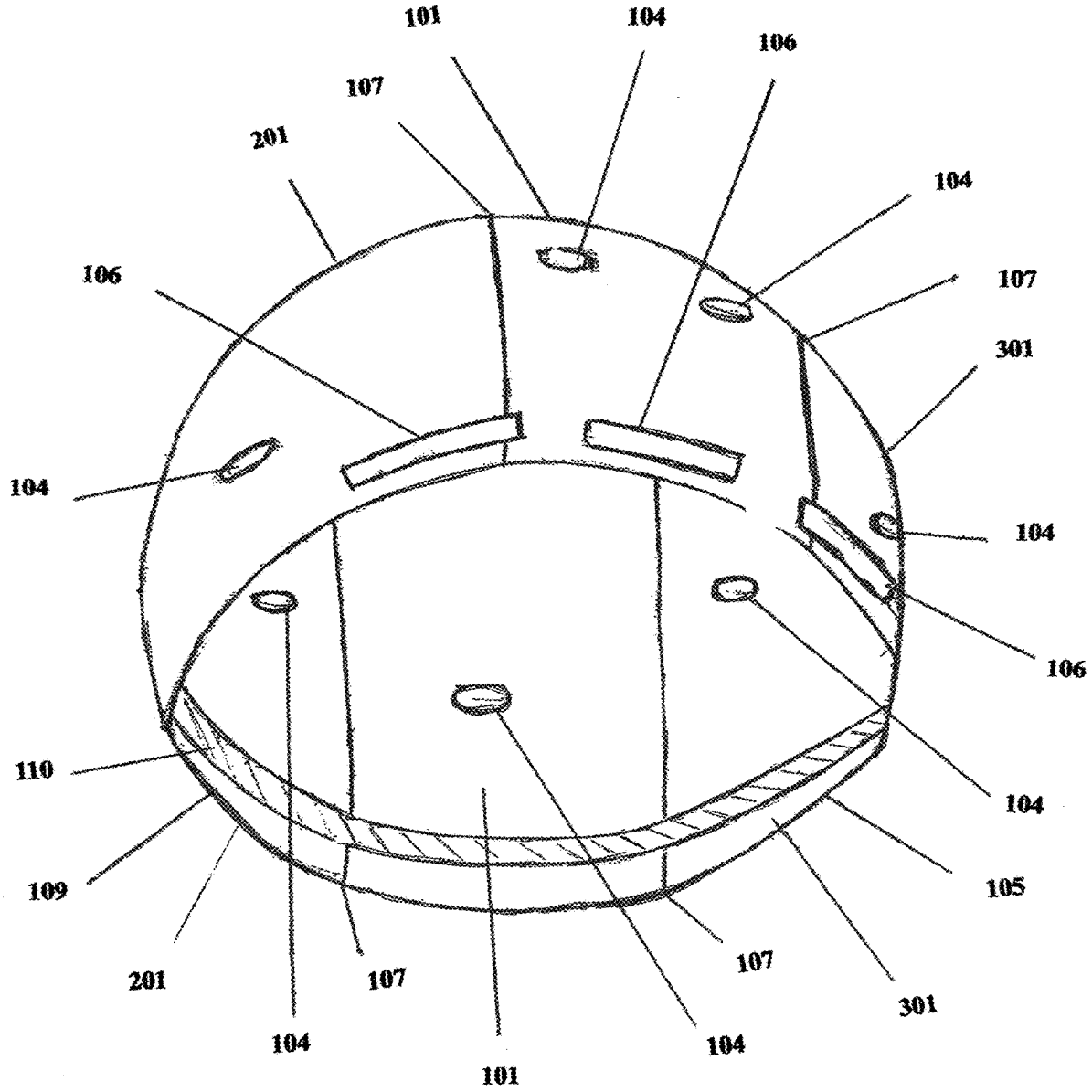
FIG. 2 UNDERSIDE VIEW

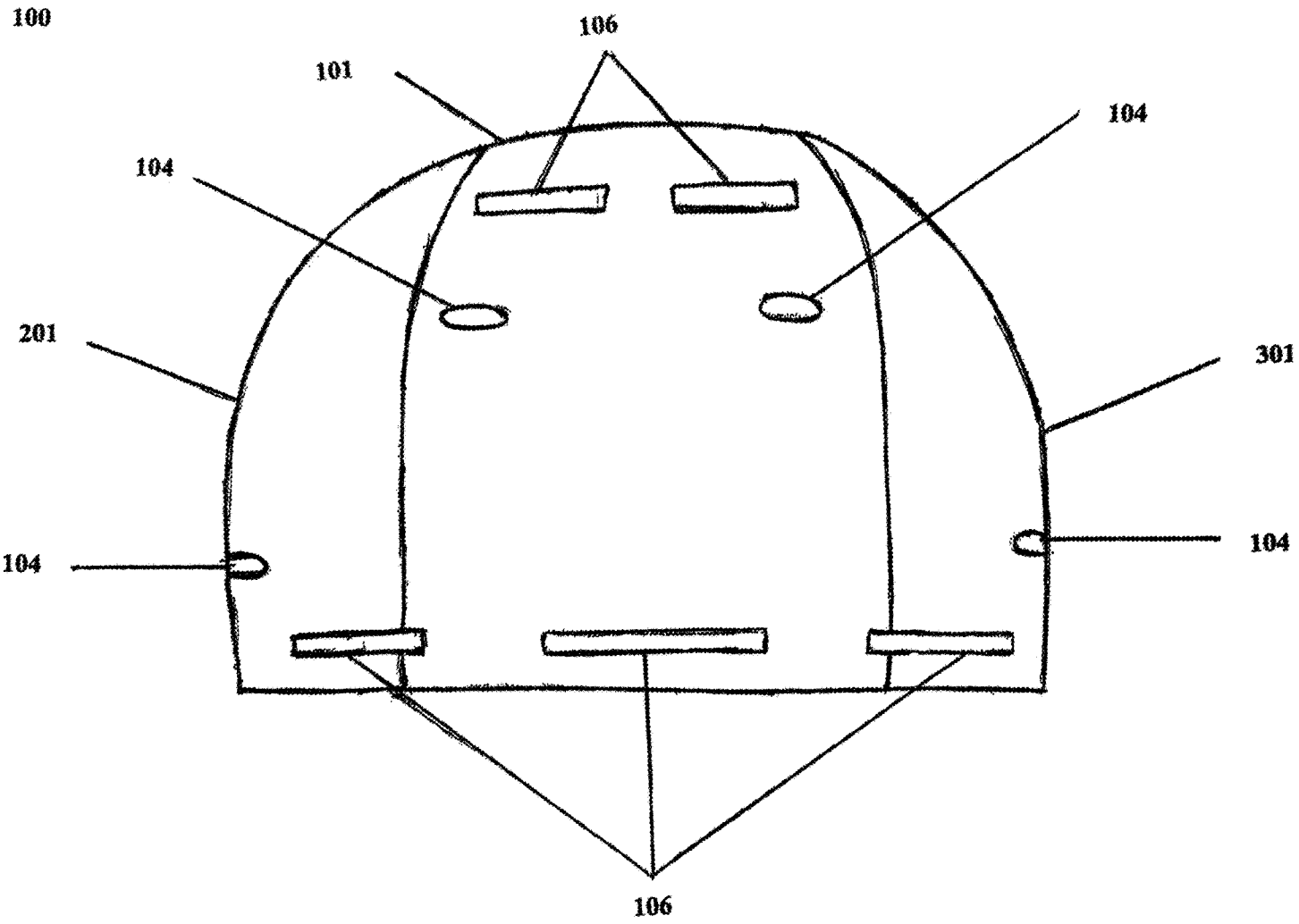
FIG. 3 FRONT VIEW

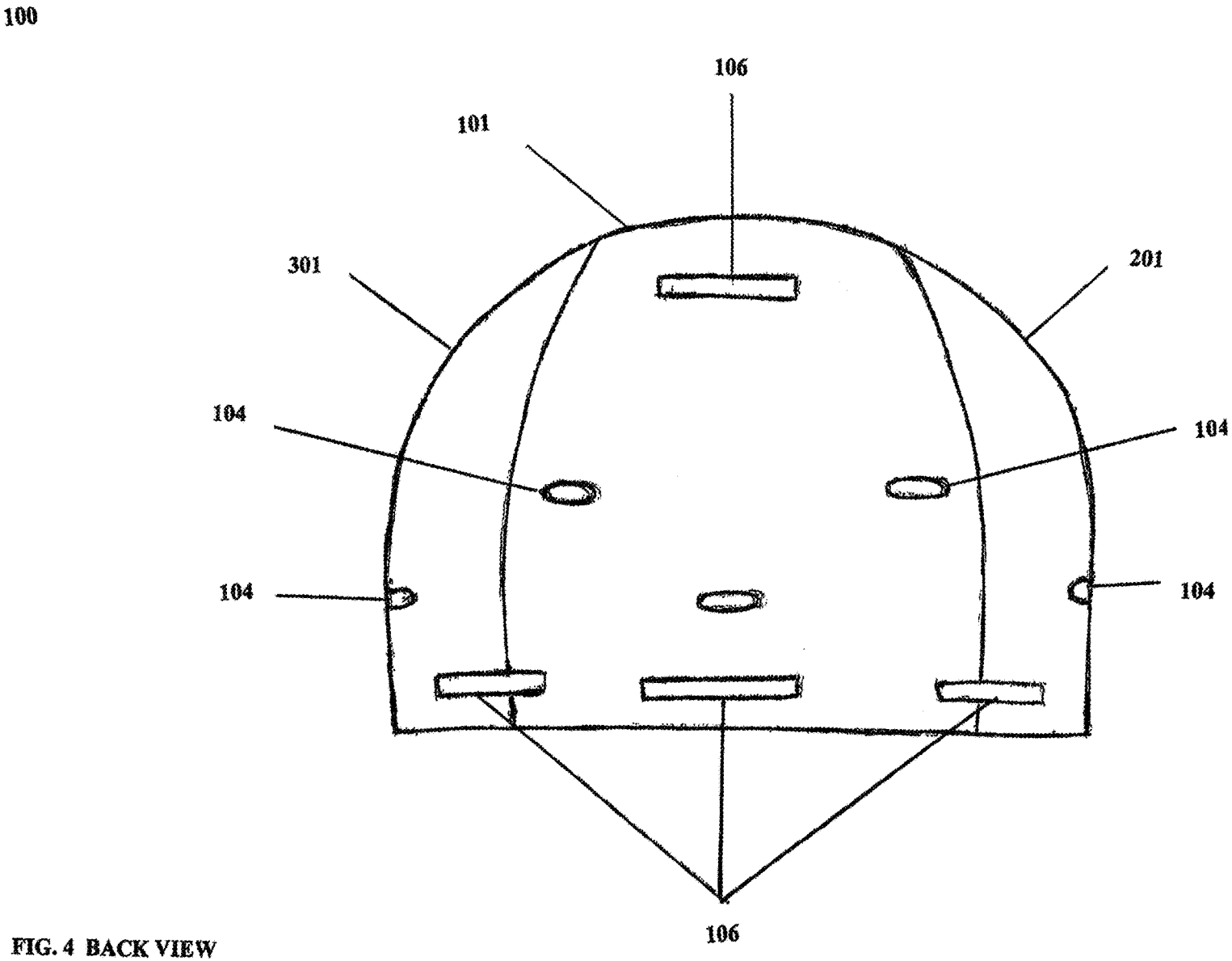
FIG. 4 BACK VIEW

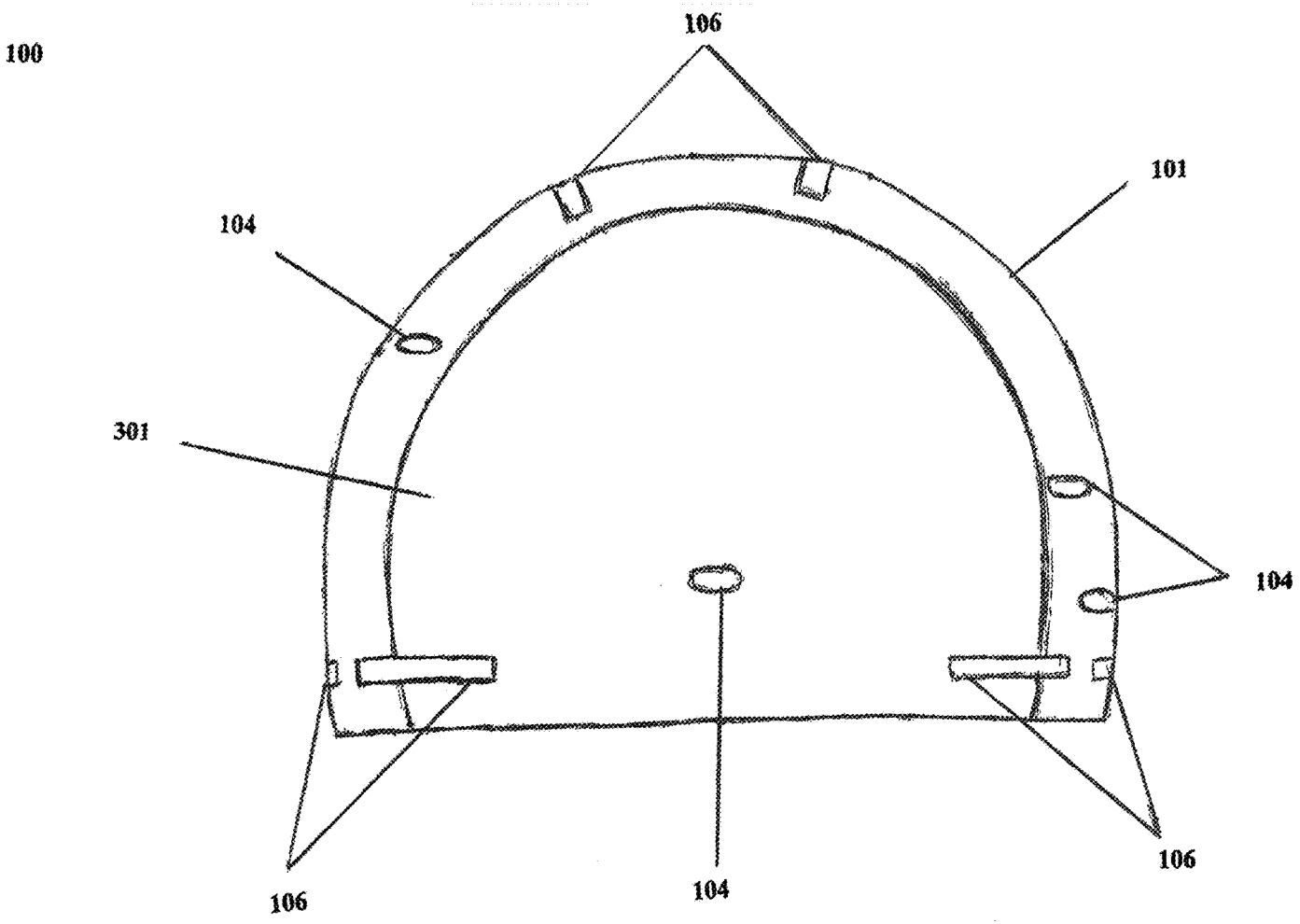
FIG. 5 SIDE VIEW

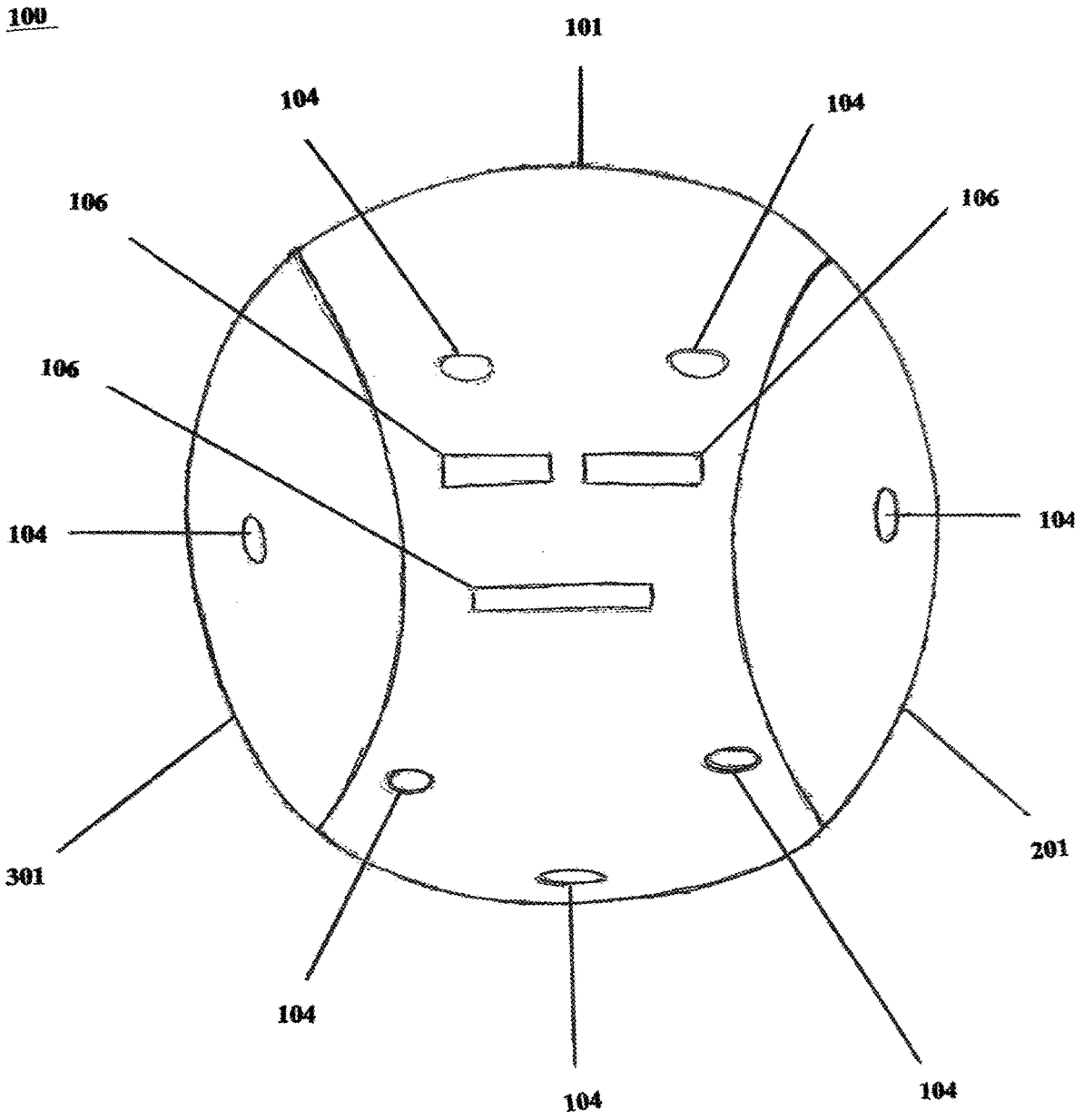
FIG. 6 TOP VIEW

WIG APPARATUS HAVING SAFEGUARDS

FIELD OF INVENTION

The present invention is related generally to wigs, and particularly to wig apparatus for securing wigs.

BACKGROUND OF THE INVENTION

Wigs have been known and worn for an assortment of reasons for many generations. Wigs are used to enhance appearance, cover insufficiencies of the hair and scalp, and for medical reasons. Wigs provide choices to individuals by helping conceal or supplement natural hair, conceal deficiencies of the hair and scalp. Wigs are comprised of a cap of mesh material with an integration of multiple synthetic or human hair material that form a unit that can be secured to a user's scalp. Wigs are also used for multiple reasons. Individuals choose to wear wigs for change in hair style, color, or texture, while others choose to wear wigs as a creative alternative for medical reasons, hair loss, or thinning hair. Wig caps have multiple functions; they are often used as a base for wigs and a barrier between the wig unit and hair and scalp.

A wig cap serves as a protective barrier between the scalp and the wig, helping to secure the wig in place preventing it from slipping. Serving as a protective barrier the wig cap keeps the user's natural hair in place, providing a smooth even surface. If not secured properly, with various fasteners, wig units have a significant probability of movement and tend to shift, slide, and fall off the user's head when worn for extended periods of time.

SUMMARY OF THE INVENTION

According to embodiments of the present invention described herein provide a wig apparatus. The wig apparatus comprises: a mesh/material framework constructed to cover a user's hair and scalp having an inner surface hair contact side and an opposite outer surface wig contact side. The wig apparatus includes a mesh/material base comprising of an inner surface, outer surface; a fold portion and terminal edge portion; an elastic band configured to extend around the user's head comprising an elastic band surface coupled to the mesh/material cap within the terminal edge portion at the coupling of the inner surface and outer surface of the mesh/material cap; and extends around a circumference of the mesh/material cap at the folded portion of the mesh/material cap; wraps around at least a portion of the bottom edge of the elastic band such that at least a portion of the outer elastic band surface is in contact with the inner surface of the mesh/material cap and at least a portion of the inner elastic band surface is in contact with the outer surface of the mesh cap; and a silicone strip is configured to extend around the circumference of the mesh/material cap on the inner surface of the mesh cap comprising a top strip edge and a bottom strip edge the silicone strip coupled to a least a portion of the elastic band of the inner surface. A plurality of loop fastener attachment members dispersed on framework of wig apparatus. A plurality of pinhole opening attachment members dispersed on framework of wig apparatus.

According to further embodiments: the inner surface faces a direction opposite the outer surface; the outer surface of the mesh/material cap is comprised of three segments, a center segment of mesh/material that extends from the frontal area to the nape area of the hair line. A plurality of loop fastener attachment members coupled to the outer surface for wig contact; a plurality of pinhole opening attachment members coupled to the inner surface and outer surface for hair contact; a right side section of mesh/material for the right side of the hair and scalp. A plurality of loop fastener attachment members coupled to the outer surface for wig contact; pinhole opening attachment members coupled to the inner surface and outer surface for hair contact; a left side segment of mesh/material for the left side of the head. A plurality of loop fastener attachment members coupled to the outer surface for wig contact; pinhole opening attachment members coupled to the inner surface and outer surface for hair contact. The loop fastener attachment members of the wig apparatus are operable to attach the center segment, right side segment, and left side segment of mesh/material cap to the underside of a wig unit. The pinhole opening attachment members of the wig apparatus are operable to attach the center segment, right side segment, left side segment of mesh/material cap to the hair and scalp of the user.

BRIEF DESCRIPTION OF THE DRAWINGS

The above and other aspects, features and advantages of certain embodiments will be more apparent from the following detailed description taken in conjunction with the accompanying drawings, in which:

FIG. 1 illustrates a wig apparatus according to an embodiment of the present invention.

FIG. 2 illustrates the wig apparatus of FIG. 1 in an underside view perspective according to an embodiment of the invention.

FIG. 3 illustrates a front perspective view of a wig apparatus according to an embodiment of the invention.

FIG. 4 illustrates a back perspective view of a wig apparatus according to an embodiment of the invention.

FIG. 5 illustrates a side perspective view of a wig apparatus according to an embodiment of the invention.

FIG. 6 illustrates a top perspective view of a wig apparatus according to an embodiment of the invention.

DETAILED DESCRIPTION OF THE PRESENT INVENTION

The following detailed description of certain embodiments will be made in reference to the accompanying drawings. In the detailed description, explanation about related function or constructions known in the art are omitted for the sake of clarity in understanding the concept of the invention, to avoid obscuring the invention with unnecessary detail.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors. The artificial hair may be configured in various textures, including curly, wavy, straight, etc. The artificial hair may be configured in various lengths and thicknesses.

The term "user," as used herein, refers to any purchaser of the wig and/or wig apparatus configured according to any of the embodiments disclosed herein, including, but not limited to, individual members of the public, wholesale distributors, retail merchants, manufacturers, importers and exporters of the wig and/or wig apparatus and related components of the wig and/or wig apparatus.

Reference to individual embodiments, whether be number of embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated.

Embodiments of the invention described herein provide a wig apparatus that is configured to fit onto and be secured efficiently to a user's head. The wig apparatus includes various components configured to securely couple the wig apparatus to the user's head while simultaneously coupling the wig apparatus to the user's head, while also providing a desirable and fashionable appearance for the user of a wig. As further described herein, the wig apparatus is configured such that a user can couple an artificial or human hair wig unit to a mesh/material cap, allowing the user to safeguard and customize the appearance of artificial hair or human hair to their own personal preference According to embodiment described herein, a wig apparatus includes a mesh/material cap composed of a center segment, a right segment, a left segment, an elastic band, and a silicone band. A portion of the mesh/material cap folds around the elastic band at an edge of the mesh/material cap. The wig apparatus includes multiple loop fastener members to couple the underside of an artificial hair or human hair to the outer surface of the mesh/material cap, and multiple pinhole opening fastener members to couple the inner mesh/material cap to the hair and scalp of the user.

The user is able to couple artificial hair products to the outer surface of the mesh/material cap, the perimeter of the mesh/material cap, as well as the inner surface of the wig apparatus to couple the wig apparatus to the user's scalp. The silicone band and the pinhole opening attachment members are disposed on the inner and outer surface of the wig apparatus. The wig apparatus allows the user to secure the placement of an artificial hair or human hair wig unit to their head for their desired appearance.

FIG. 1 illustrates a wig apparatus 100, according to an embodiment of the present invention. The wig apparatus 100 composed of a mesh cap that includes an outer and inner center segment 101, an outer and inner right segment 201, an outer and inner left segment 301, seams 107, multiple loop fasteners for outer surface segments 106, multiple pinhole openings 104 for inner surface segments, an elastic band 109, and a silicone band 110. The wig apparatus 100 is configured in such a way that the underside of the artificial hair can be coupled to an outer surface thereof. The artificial hair can be attached to the outer surface with wig combs and hair pins to the outer and inner surface to secure a user's hair to the mesh/material cap 100. A user can customize their appearance with the wig apparatus 100 by selecting various colors, textures, and lengths of artificial hair to couple to the outer surface of the wig apparatus 100.

The mesh/material cap 100 is configured to cover the scalp of a user. In other words, the mesh cap is configured in a dome shape. The mesh/material cap includes an outer surface area and an inner surface area. The mesh/material cap is constructed of cotton, nylon, micro, elastic, spandex, net stretch fabric, or other suitable material and combination thereof.

In certain embodiments, the mesh/material cap 100 includes holes of the same or various sizes in the surface throughout the mesh/material cap 100.

FIG. 2 illustrates an underside view of a wig apparatus 100, according to the embodiment of the present invention. The wig apparatus 100 shown in FIG. 1 is in an under side configuration for illustration purposes. The wig apparatus 100 includes a mesh/material cap 100 having an inner hair contact side 101, 201, 301, and a opposite outer wig contact side 101, 201, 301. Multiple designated pinhole opening attachments 104 for the hair contact side placed at the crown 101, sides 201, 301 and back 101 of the wig apparatus 100 and is operable to engage and securely attach the wig apparatus 100 to the user's head without glue or adhesives. Multiple designated loop fastener attachments 106 for the artificial hair contact side 104 placed at the crown 101, front 201, sides 301 and back 101 outer surface sections of the wig apparatus 100 and is operable to engage and retain and underside of a wig to secure the wig apparatus 100 to the user's head with any materials suitable to be attached to and removed from a user's head.

The mesh/material cap 100 includes a folded portion 105 that wraps around the elastic band 109. The elastic band 109 extends around the circumference of the mesh cap 100.

The elastic band is constructed of an elastic material, such as cotton, nylon, micro, elastic, spandex, net stretch fabric, or other suitable material and combinations thereof.

In certain embodiments the elastic band 109 is sewn, glued, or attached by any other suitable method, to the mesh/material cap 100. The elastic band 109 is configured to extend around the user's head, securing the wig apparatus 100 in place. When the wig apparatus is worn by the user, the elastic band 109 extends across the forehead, around the temples' and around the head in a location approximately corresponding to the user's hairline.

In certain embodiments, the folded portion 105 of the mesh/material cap 100 wraps around at least a portion of the bottom edge of the elastic band 109 so that a portion of the outer elastic band surface is in contact with the inner surface of the mesh/material cap 100. The elastic band is coupled between the inner and outer surface segments 101, 201, 301 within the bottom edge of the folded seams of the mesh/material cap 100. Resulting in a portion of the folded portion 105 is in contact with the inner surface section.

In certain embodiments, the elastic band 109 is about 0.5 cm to 3 cm in thickness. In certain embodiments the elastic band 109 is 0.75 cm to 2 cm in thickness. In certain embodiments the elastic band 109 is 1 cm to 4 cm in thickness. The elastic band is not limited to a particular thickness and can vary according to the functional needs of the wig apparatus 100.

In certain embodiments the silicone band 110 extends around a circumference of the mesh/material cap 100. The silicone band 110 includes a top strip edge and a bottom strip edge. The silicone band 110 is constructed of silicone, rubber, or other suitable material. The silicone band 110 is configured to provide an anti-slip surface between the user's natural hair or scalp and the wig apparatus 100. In certain embodiments the silicone band 110 is coupled to the elastic band 109. In certain embodiments the silicone band 109 is sewn, glued or attached by any other suitable method to the elastic band 109.

In certain embodiments the thickness of the silicone band 110, is less than the thickness of the elastic band 109. In certain embodiments, the thickness of the silicone band 110 is greater than the thickness of the elastic band 109. In certain embodiments, the thickness of the silicone band 110 is equal to the thickness of the elastic band 109

In certain embodiments the folded portion 105 of the mesh/material cap 100 does not overlap the silicone band 110. In other words, the folded portion 105 does not extend over the silicone strip 110 and does not extend underneath the silicone strip 110.

As illustrated in FIGS. 1 and 2, in certain embodiments, a plurality of loop fastener attachments 106 are distributed on the outer surface of the mesh/material cap at the front, and temple, crown, back and nape area. Wig comb is suitable to use to couple the underside of artificial hair to wig apparatus. The wig comb includes tines that are inserted and secured onto the loop fasteners. The wig comb secures and retains the wig apparatus 100 to the user's artificial hair.

As illustrated in FIGS. 1 and 2, in certain embodiments, a plurality of pinhole opening attachment members 104 are distributed on the outer and inner surface of the mesh/material cap at the front, side, back and nape area. Hair pin is suitable to use to couple the underside wig apparatus to user's hair.

The hair pins are inserted and secured into the pinhole opening attachment members 104. The hair pin secures and retains the wig apparatus 100 to the user's hair.

As illustrated in FIGS. 1 and 2, in certain embodiments, the mesh/material cap 100 includes multiple seams 107. The mesh/material cap 100 is constructed of three separate segments of material that are sewn together along seams 107.

FIG. 3 illustrates the front view of the wig apparatus 100.

FIG. 4 illustrates the back view of the wig apparatus 100.

FIG. 5 illustrates the side view of the wig apparatus 100.

FIG. 6 illustrates a top view of the wig apparatus 100.

Embodiments of the invention described herein provide a wig apparatus that is configured to fit onto, and with a secured fit onto, a user's head. The wig apparatus includes various components configured to securely couple the wig apparatus to the user's head, while simultaneously allowing the user to couple artificial hair to the wig apparatus so that the user can customize their own preferred style.

Embodiments of the invention described herein are for the purposes of promoting an understanding of the principles of the invention, references have been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity conventional aspects of the system (and components of the individual operating components of the system) may not be described in detail. Furthermore, the connecting line, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modification and adaptations will be readily apparent to those skilled in this art without departing from the spirit and scope of the present invention.

What is claimed is:

1. A wig cap system consisting of:

a wig cap having a center segment, a right segment and a left segment, where the center, right and left segments are each made of a mesh material, and the right and left segments are symmetrical;

the center segment having a front edge configured to extend adjacent a user's forehead, a rear edge configured to extend adjacent a nape portion of the user and opposing right and left edges extending between the front and rear edges, where the front and rear edges define a portion of the boundary of the wig cap;

the right segment having a first lower edge and a first arcuate edge, where the first lower edge forms a portion of the boundary of the wig cap extending between a first end of the front edge to a first end of the rear edge;

the left segment having a second lower edge and a second arcuate edge, where the second lower edge forms a portion of the boundary of the wig cap extending between a second end of the front edge to a second end of the rear edge such that the front edge, the rear edge, the first lower edge and the second lower edge form a circular shape;

where the right edge of the center segment is joined to the first arcuate edge via a first seam and the left edge of the center segment is joined to the second arcuate edge via a second seam, the wig cap having a dome-shape with an inner surface and an outer surface, the wig cap being configured to cover a user's scalp such that the inner surface contacts a user's hair;

at least one first loop disposed on the outer surface of the wig cap in an apex region of the center segment;

a second loop disposed on the outer surface adjacent the front edge and a third loop disposed on the outer surface adjacent the rear edge, where the second and third loops are on the center segment;

fourth and fifth loops disposed on the outer surface of opposing sides of the right segment adjacent the first lower edge and end portions of the first arcuate edge;

sixth and seventh loops disposed on the outer surface of opposing sides of the left segment adjacent the second lower edge and end portions of the second arcuate edge;

wherein each of the at least one first loop and each of the second, third, fourth, fifth, sixth and seventh loops are configured to engage with a wig comb for coupling artificial hair to the wig cap;

a plurality of openings for pinning the wig cap to a user's natural hair, where each of the plurality of openings is different from apertures defined by the mesh material forming the center, right and left segments;

wherein the plurality of openings are positioned at discrete locations of the center, right and left segments such that: i) first and second openings of the plurality of openings are disposed on the center segment between the at least one first loop and the second loop, ii) third and fourth openings of the plurality of openings are disposed on the center segment between the at least one first loop and the third loop, iii) a fifth opening of the plurality of openings is disposed on the right segment at a central location between opposing ends of the first lower edge and spaced apart from the first lower edge such that the fourth and fifth loops are closer to the first lower edge compared to the fifth opening and iv) a sixth opening of the plurality of openings is disposed on the left segment at a central location between opposing ends of the second lower edge and spaced apart from the second lower edge such that the sixth and seventh loops are closer to the second lower edge compared to the sixth opening;

an elastic band coupled to the inner surface of the wig cap adjacent the boundary, wherein a folded portion of the wig cap extending upwardly and inwardly from the front, rear, first and second lower edges is disposed over at least a portion of a lower edge of the elastic band such that an outer surface of the elastic band is in contact with the inner surface of the wig cap and a front surface of the elastic band is in contact with at least a portion of the folded portion of the wig cap;

a silicone or rubber strip coupled to the inner surface of the elastic band; and at least one hair pin for securing the wig cap to a user's hair via the plurality of openings.

2. The wig apparatus according to claim 1, wherein a thickness of the silicone or rubber strip is less than a thickness of the elastic band.

3. The wig apparatus according to claim 1, wherein a thickness of the silicone or rubber strip is about equal to a thickness of the elastic band.

4. The wig apparatus according to claim 1, wherein a thickness of the silicone or rubber strip is selected from one of about half, about one quarter, and about three quarters of a thickness of the elastic band.

5. The wig apparatus according to claim 1, wherein the folded portion extends up to a bottom strip edge of the silicone or rubber strip.

6. The wig apparatus according to claim 1, wherein the folded portion extends underneath the silicone or rubber strip such that at least a portion of the folded portion is disposed between the silicone or rubber strip and the elastic band.

7. The wig apparatus according to claim 1, wherein the folded portion extends underneath the silicone or rubber strip such that at least a portion of the folded portion is disposed between the silicone or rubber strip and the elastic band, and wherein at least a portion of the folded portion extends beyond a top strip edge of the silicone or rubber strip.

8. The wig apparatus according to claim 1, wherein the folded portion extends underneath the silicone strip such that at least a portion of the folded portion is disposed between the silicon or rubber strip and the elastic band, and wherein at least a portion of the folded portion extends beyond the top strip edge of the silicone or rubber strip and does not extend beyond the elastic band.

9. The wig apparatus according to claim 1, wherein the at least one first loop includes two first loops.

* * * * *